US009283574B2

(12) United States Patent
Leistiko

(10) Patent No.: US 9,283,574 B2
(45) Date of Patent: Mar. 15, 2016

(54) CLEAN OUT SPRAY NOZZLE

(71) Applicant: Munson Industries, LLC, Chardon, OH (US)

(72) Inventor: Patrick M Leistiko, Chardon, OH (US)

(73) Assignee: Munson Industries, LLC, Chardon, OH (US)

( * ) Notice: Subject to any disclaimer, the term of this patent is extended or adjusted under 35 U.S.C. 154(b) by 0 days.

(21) Appl. No.: 14/286,052

(22) Filed: May 23, 2014

(65) Prior Publication Data

US 2014/0252136 A1 Sep. 11, 2014

Related U.S. Application Data

(62) Division of application No. 13/070,832, filed on Mar. 24, 2011, now abandoned.

(51) Int. Cl.

| | |
|---|---|
| ***B05B 1/30*** | (2006.01) |
| ***B05B 1/14*** | (2006.01) |
| ***B05B 1/34*** | (2006.01) |
| ***B05B 15/02*** | (2006.01) |

(52) U.S. Cl.
CPC ... *B05B 1/14* (2013.01); *B05B 1/34* (2013.01); *B05B 15/0208* (2013.01)

(58) Field of Classification Search
CPC ..... B05B 1/14; B05B 1/34; B05B 15/0208
USPC ..... 239/466, 553, 486–497, 380–382, 463, 239/467, 472, 474, 476, 469, 470, 475
See application file for complete search history.

(56) References Cited

U.S. PATENT DOCUMENTS

| | | | | | |
|---|---|---|---|---|---|
| 916,984 | A | | 4/1909 | Bleymehl | |
| 920,818 | A | | 5/1909 | Breckenridge | |
| 1,453,161 | A | * | 4/1923 | Murphy | B05B 1/3436 239/472 |
| 1,688,585 | A | * | 10/1928 | Lalor et al. | F23D 11/24 239/488 |
| 1,840,453 | A | * | 1/1932 | Keith | F23D 14/48 239/487 |
| 2,321,428 | A | * | 6/1943 | Schloz | F23D 11/383 239/466 |
| 2,539,061 | A | | 1/1951 | Coles | |
| 2,621,077 | A | * | 12/1952 | Pieroni | 239/533.2 |
| 2,626,836 | A | | 1/1953 | Herron | |

(Continued)

OTHER PUBLICATIONS

Rackers, Thomas, "Clogging in Continuous Casting Nozzles," 78th Steelmaking Conference Proceedings, Nashville, TN, Apr. 2, 1995, Iron and Steel Society, Warrendale, PA, vol. 78, 1995, pp. 723-734.

*Primary Examiner* — Joel Zhou
(74) *Attorney, Agent, or Firm* — Emerson Thomson Bennett, LLC; Daniel A. Thomson

(57) ABSTRACT

A spray nozzle includes a nozzle body, the body having an inner wall and an outer wall, a first opening, a second opening, wherein the diameter of the second opening is less than the diameter of the first opening, wherein the first and second openings have threaded portions, a spray opening, the spray opening at an end of the second opening, and an inner vane, wherein the inner vane includes threads corresponding to the threads of the second opening, a vane face, wherein the vane face faces toward the spray opening, a vane protrusion, the protrusion being perpendicular to the face, wherein the face and the protrusion are on opposite sides of the vane, wherein the vane protrusion faces away from the spray opening, at least one vane groove emanating outwardly from the center of the vane face.

20 Claims, 5 Drawing Sheets

(56) References Cited

U.S. PATENT DOCUMENTS

| | | | | |
|---|---|---|---|---|
| 2,657,953 | A | 11/1953 | Hopper | |
| 3,961,756 | A * | 6/1976 | Martini | 239/337 |
| 4,187,985 | A | 2/1980 | Goth | |
| 5,039,062 | A * | 8/1991 | England | F16K 35/06 137/385 |
| 5,152,463 | A * | 10/1992 | Mao | B05B 1/3426 239/402 |
| 5,522,549 | A | 6/1996 | Sheu | |
| 7,516,908 | B1 | 4/2009 | Sack | |
| 7,578,454 | B2 | 8/2009 | Joo | |
| 2007/0241210 | A1 | 10/2007 | Schindler et al. | |
| 2012/0060939 | A1 * | 3/2012 | Schwartz | F15D 1/04 137/15.01 |

* cited by examiner

CLEAN OUT SPRAY NOZZLE

This application is a divisional application of, and claims priority to, Ser. No. 13/070,832, filed Mar. 24, 2011, which claims priority to a provisional patent application, Ser. No. 61/370,672, filed Aug. 4, 2010, entitled CLEAN OUT SPRAY NOZZLE, the contents of which are hereby incorporated by reference. This invention pertains to the art of methods and apparatuses regarding spray nozzles, and more specifically to apparatuses and methods regarding clean out spray nozzles.

I. BACKGROUND

Clogged nozzles are difficult problem in the industry. A clogged nozzle has a blocked orifice or vane which does not allow fully spray angle formation. Distribution of the fluid is interrupted and the spray tends to be uneven with heavy areas and voids. The flow rates are reduced and droplet spectrum shifts. A clogged or partially clogged nozzle cannot create the desired droplet size.

II. BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein.

III. DEFINITIONS

Figure 1:
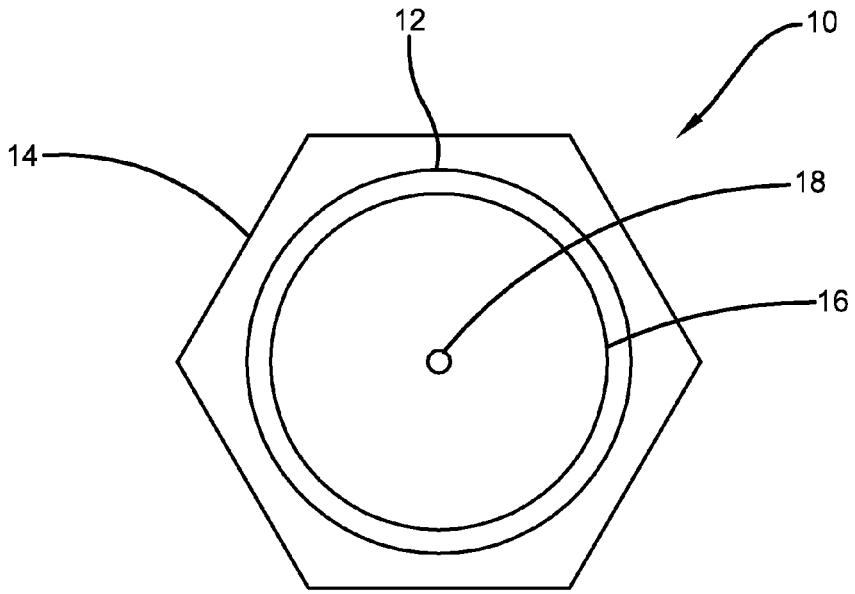
FIG. 1 shows a top view of a nozzle body.
Figure 2:
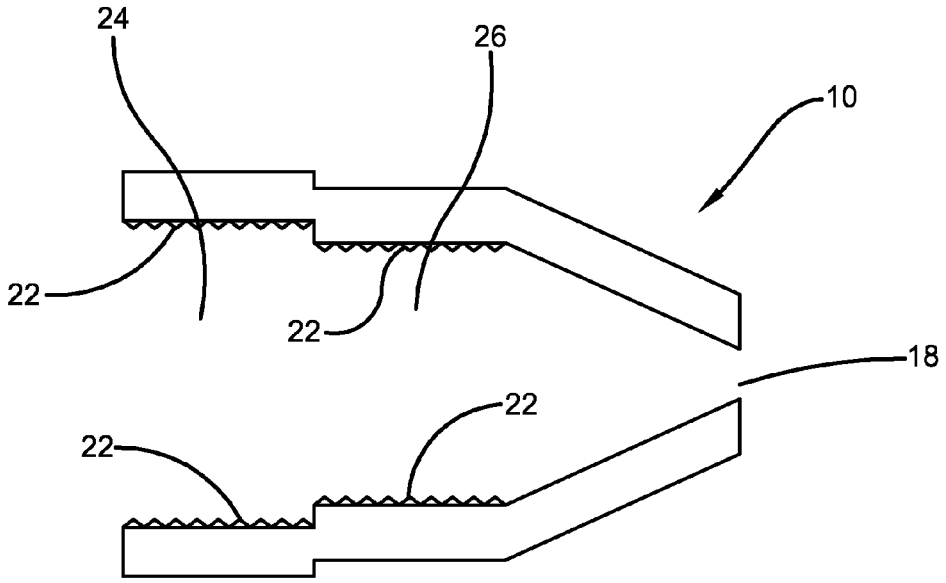
FIG. 2 shows a cut away view of the nozzle body.
Figure 3:
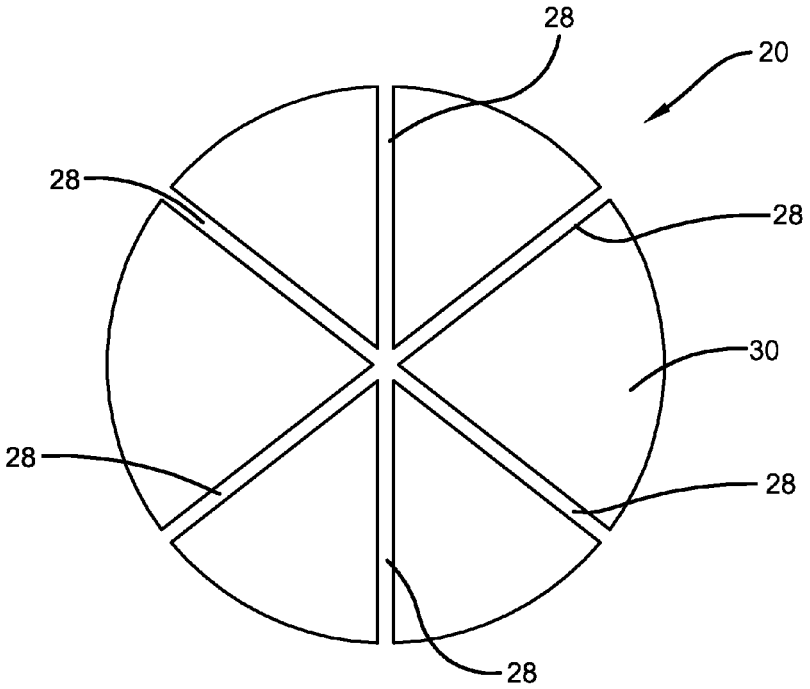
FIG. 3 shows a top view of an inner vane.
Figure 4:
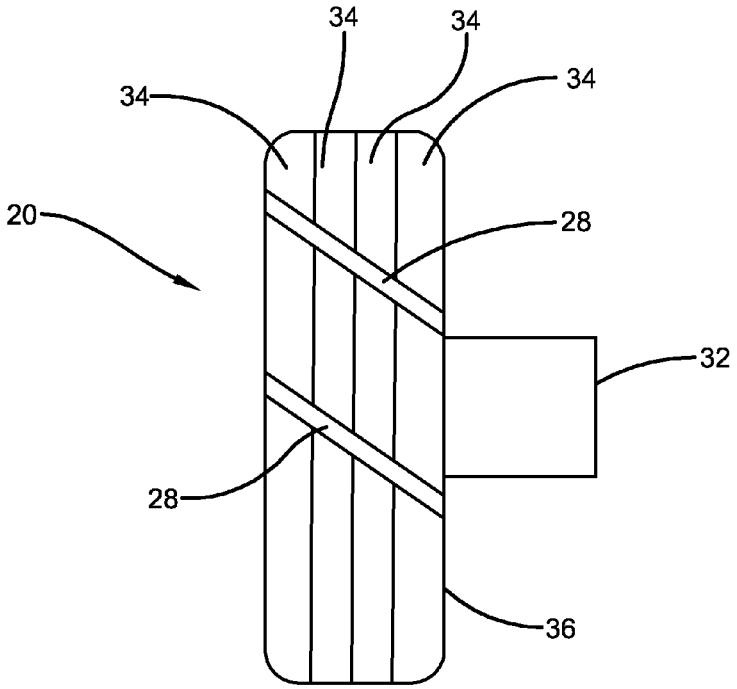
FIG. 4 shows a side view of the inner vane.

The following terms may be used throughout the descriptions presented herein and should generally be given the following meaning unless contradicted or elaborated upon by other descriptions set forth herein.

Groove—a long narrow furrow cut by a tool.

Nozzle—a mechanical device designed to control the direction or characteristics of a fluid flow as it exits (or enters) an enclosed chamber or pipe via an orifice.

Vane—a structure used to direct flows through a nozzle.

Threads—raised helical ribs going around a structure used for connection.

IV. SUMMARY

In accordance with one aspect, a spray nozzle includes a nozzle body, the body having an inner wall and an outer wall, a first opening, a second opening, wherein the diameter of the second opening is less than the diameter of the first opening, wherein the first and second openings have threaded portions, a spray opening, the spray opening at an end of the second opening, and an inner vane, wherein the inner vane includes threads corresponding to the threads of the second opening, a vane face, a vane protrusion, the protrusion being perpendicular to the face, wherein the face and the protrusion are on opposite sides of the vane, and vane grooves emanating outwardly from the center of the vane face, wherein the vane grooves extend down a side of the vane at substantially a 45 degree angle.

In accordance with another aspect, an inner vane for use with an associated spray nozzle, wherein the nozzle has a nozzle body, the body having an inner wall and an outer wall, a first opening, a spray opening, includes at least one vane groove, the vane groove extending between a vane face and a second side of the vane, wherein the inner vane is removably attachable within the nozzle body.

In accordance with another aspect, the at least one vane groove extends across the entire vane face.

In accordance with another aspect, the vane has a vane protrusion, which works operatively with an associated removal tool for the selective removal of the vane.

In accordance with another aspect, the vane has a threaded portion coinciding with a threaded portion of the inner wall of the nozzle body.

In accordance with another aspect, the at least one groove cuts across the threaded portion of the vane.

In accordance with another aspect, the at least one groove comprises at least three grooves, wherein the grooves intersect each other to form six triangular portions.

In accordance with another aspect, the groove on the threaded portion extends diagonally from the vane face to the second side at approximately a 45 degree angle.

In accordance with another aspect, six grooves on the threaded portion extend diagonally from the vane face to the second side at approximately a 45 degree angle.

In accordance with another aspect, the grooves on the face form angles of approximately 60 degrees.

In accordance with another aspect, the grooves extend to form notches on the second side of the vane, wherein the notches are at approximately 60 degree angles with respect to each other.

In accordance with another aspect, a method for cleaning a spray nozzle, the method includes the steps of providing the spray nozzle having a nozzle body, the body having an inner wall and an outer wall, a first opening, a spray opening, providing an inner vane, which is selectively attachable to the nozzle body, attaching an associated removal tool to a protrusion protruding from the vane, removing the vane from the nozzle body, cleaning the vane, and re-inserting the vane into the nozzle body.

In accordance with another aspect, the vane and the inner wall have matching threaded portions for removal and re-insertion of the vane.

In accordance with another aspect, the vane has at least one groove passing from a face to a second side of the vane to allow for flow of liquid.

In accordance with another aspect, the at least one groove is three intersecting grooves.

V. DETAILED DESCRIPTION

Referring now to the drawings wherein the showings are for purposes of illustrating embodiments of the invention only and not for purposes of limiting the same, FIGS. 1-9 show the inventive nozzle, including a nozzle body 10, a first inner wall 12, an outer wall 14, a second inner wall 16, a spray opening 18, an inner vane 20, threads 22, a first opening 24, a second opening 26, vane grooves 28, a vane face 30, a vane protrusion 32, threads 34, a second side 36, notches 38, a removal tool 40.

With continuing reference to the FIGURES, the nozzle body 10 has a spray opening 18 at one end and a first opening 24 at the other end. The body 10 also has an outer wall 14, a first inner wall 12, and a second inner wall 16. Below the first opening 24 within the body 10 is a second opening 26, which in this embodiment has a smaller diameter than the first opening 24. In this embodiment, the first inner wall 12 coincides with the first opening 24, and the second inner wall 16 coincides with the second opening 26. In this embodiment, at least the second opening has a threaded portion 22 for receiving the threads 34 on the vane 20.

Figure 5:
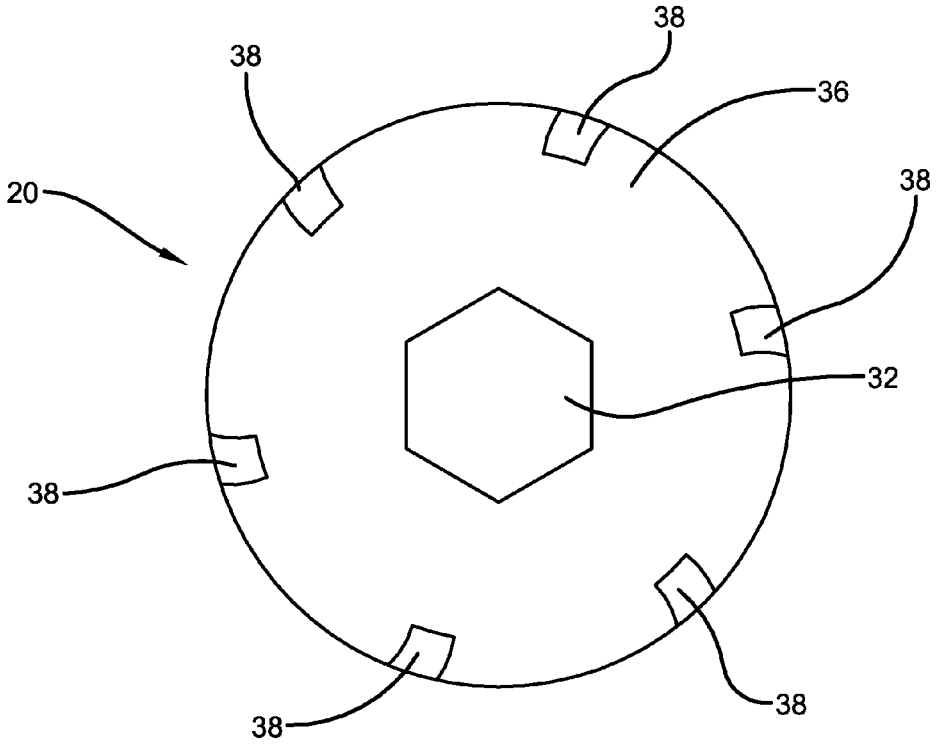
FIG. 5 shows a bottom view of the inner vane.
Figure 6:
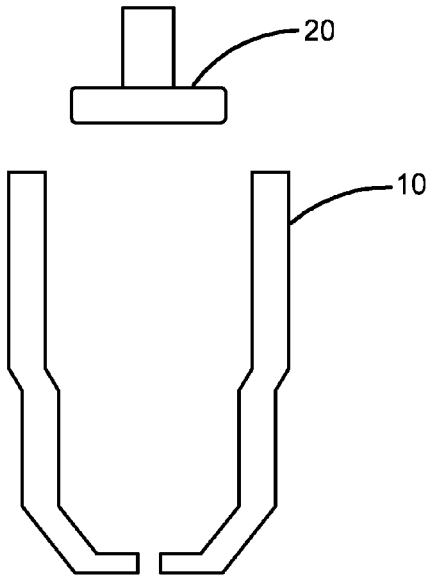
FIG. 6 shows the inner vane being inserted into the nozzle body.
Figure 7:
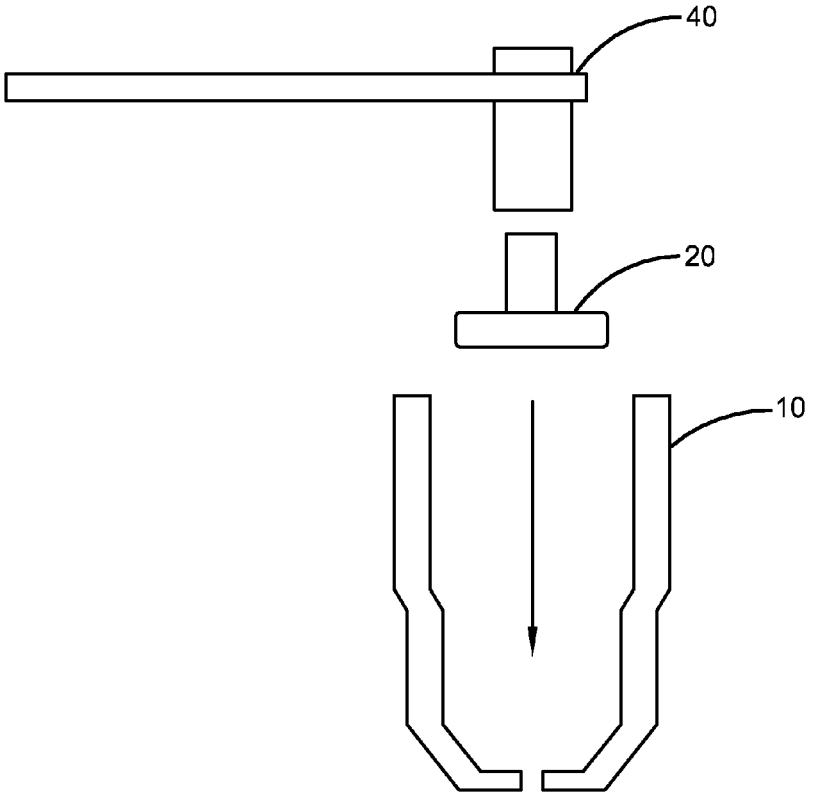
FIG. 7 shows the inner vane, nozzle body, and a removal tool.
Figure 8:
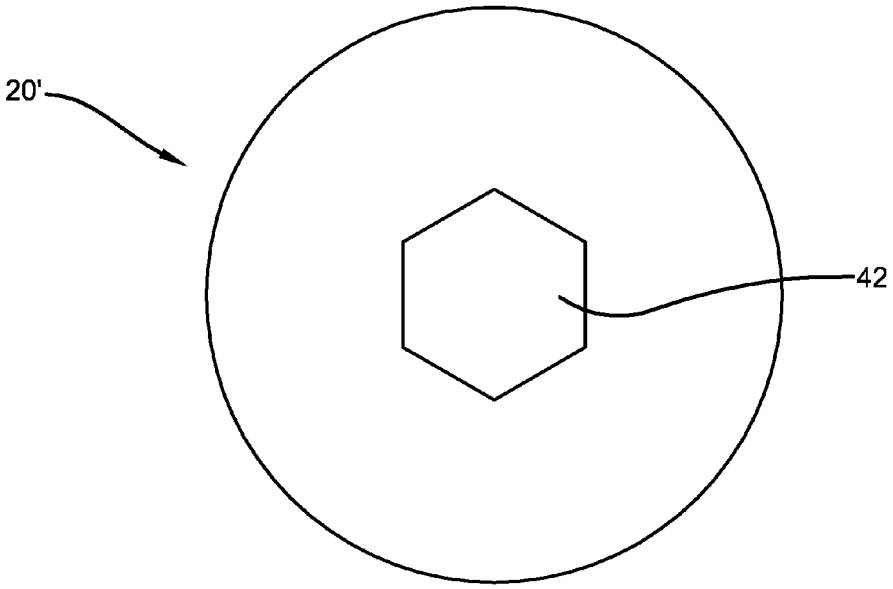
FIG. 8 shows another embodiment of the inner vane.
Figure 9:
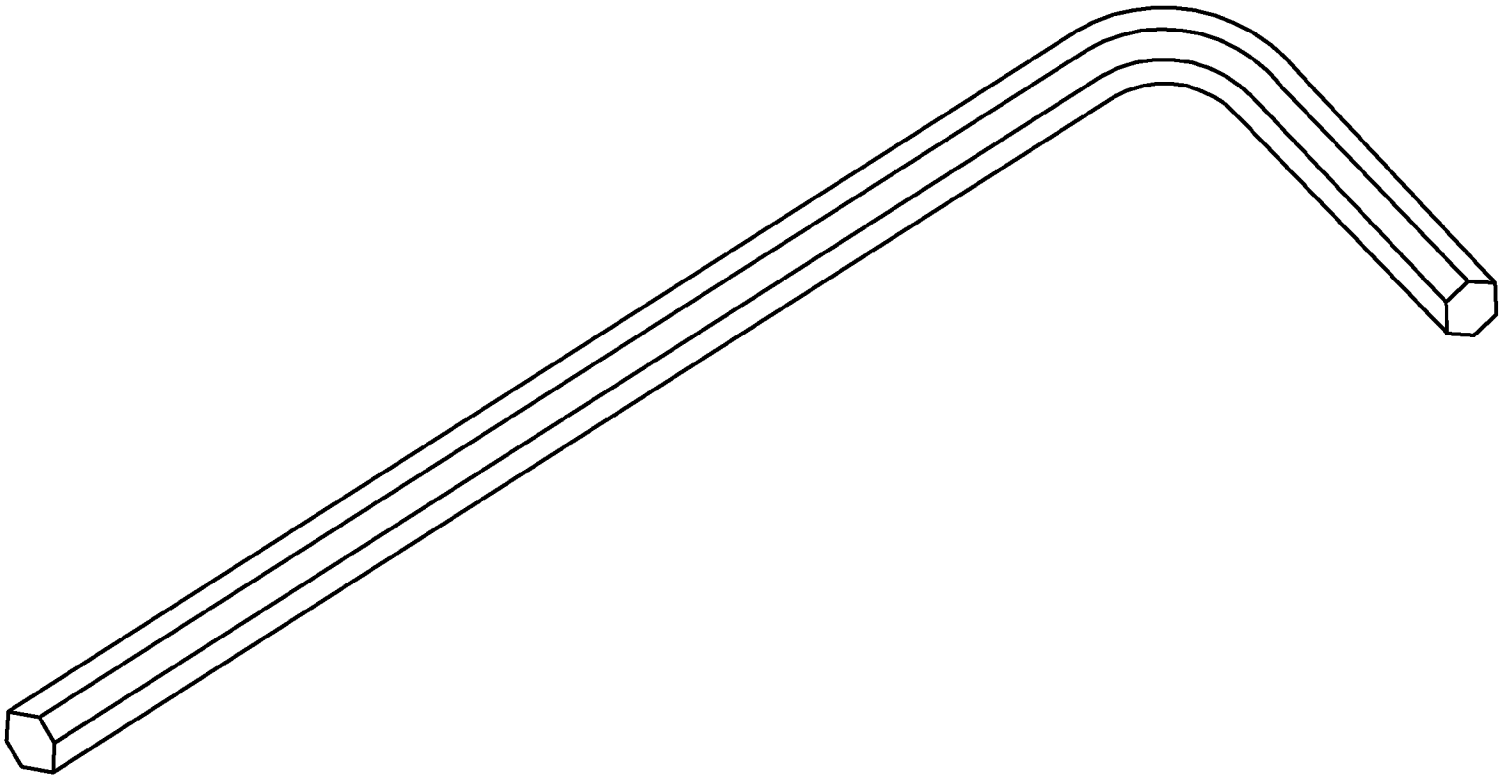
FIG. 9 shows a hex key.

With continuing reference to the FIGURES, the vane 20, in one embodiment, has at least one groove 28 extending across the face 30. In one embodiment, the vane face 30 has three grooves 28 extending across the face 30 and extending downwardly across the threads 34. In one embodiment, the grooves 28 extend across the threads 34 at approximately a 45 degree angle. It is to be understood that any angle across the threads can be used, as long as chosen using sound engineering judgment. In one embodiment, the angle is between approximately 0 degrees and approximately 60 degrees (which includes, without limitation, 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, and 60 degrees). In another embodiment the angle is between approximately 15 degrees and approximately 45 degrees (which includes, without limitation, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, and 45 degrees). In another embodiment the angle is between approximately 30 degrees and approximately 45 degrees (which includes, without limitation, 30, 31, 32, 33, 34, 35, 36, 37, 38, 39, 40, 41, 42, 43, 44, and 45 degrees). As shown in FIG. 5, in one embodiment, the grooves 28 extend onto the second side 36 of the vane 20, forming notches 38.

With continuing reference to the FIGURES, in one embodiment, the inner vane 20 is selectively removable from the body 10. In this embodiment, the inner vane 20 has a male portion (vane protrusion) 32 that mates with the female portion of a socket wrench 40. Another embodiment has the inner vane 20' with a female portion 42 that mates with the male portion of an Allen wrench (or hex key), shown in FIG. 9. Once the nozzle becomes clogged, the vane 20 can be quickly removed for cleaning, then quickly re-inserted. The vane 20 or vane 20' is removed with either a female removal tool 40 or a male removal tool (such as a hex key), and in one embodiment, the removal is effectuated through the use of threads 22, 34. Once the vane 20, 20' is removed, it can be cleaned, then re-inserted into the body 10. In one embodiment, when the vane 20, 20' is in place within the body, the second side 36 of the vane 20, 20' is substantially flush with the top of the second opening 26.

It is to be understood that any size nozzle or vane configuration can be used with this invention.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A spray nozzle comprising: a nozzle body, the body having an inner wall and an outer wall; a first opening; a second opening, wherein the diameter of the second opening is less than the diameter of the first opening, wherein the first and second openings have threaded portions; a spray opening, the spray opening at an end of the second opening; and, an inner vane, wherein the inner vane comprises: threads corresponding to the threads of the second opening; a vane face, wherein the vane face faces toward the spray opening; a vane protrusion, the vane protrusion being perpendicular to the face, wherein the face and the protrusion are on opposite sides of the vane, wherein the vane protrusion faces away from the spray opening; and, at least one vane groove emanating outwardly from the center of the vane face.

2. The spray nozzle of claim 1, wherein the at least one vane groove extends down a side of the vane at an angle of between about 0 degrees and about 60 degrees.

3. The spray nozzle of claim 2, wherein the at least one vane groove extends across the entire vane face.

4. The spray nozzle of claim 3, wherein the vane protrusion works operatively with an associated removal tool for the selective removal of the vane.

5. The spray nozzle of claim 4, wherein the at least one groove cuts across the threaded portion of the vane.

6. The spray nozzle of claim 5, wherein the at least one groove comprises at least three grooves, wherein the grooves intersect each other to form six triangular portions.

7. The spray nozzle of claim 6, wherein the six grooves on the threaded portion extend diagonally from the vane face to the second side at approximately a 45 degree angle.

8. The spray nozzle of claim 7, wherein the six grooves on the face form angles of approximately 60 degrees.

9. The spray nozzle of claim 8, wherein the six grooves extend to form notches on the second side of the vane, wherein the notches are at approximately 60 degree angles with respect to each other.

10. The spray nozzle of claim 2, wherein the at least one vane groove extends down a side of the vane at an angle of between about 15 degrees and about 45 degrees.

11. The spray nozzle of claim 10, wherein the at least one vane groove extends down a side of the vane at an angle of between about 30 degrees and about 45 degrees.

12. A spray nozzle comprising:

a nozzle body, the body having an inner wall and an outer wall;

a first opening;

a second opening, wherein the diameter of the second opening is less than the diameter of the first opening, wherein the first and second openings have threaded portions;

a spray opening, the spray opening at an end of the second opening; and, an inner vane, wherein the inner vane comprises:

threads corresponding to the threads of the second opening;

a vane face, wherein the vane face faces toward the spray opening;

a female portion, the female Portion being perpendicular to the face, wherein the face and the female portion are on opposite sides of the vane, wherein the female portion faces away from the spray opening;

at least one vane groove emanating outwardly from the center of the vane face.

13. The spray nozzle of claim 12, wherein the at least one vane groove extends down a side of the vane at an angle of between about 0 degrees and about 60 degrees.

14. The spray nozzle of claim 13, wherein the at least one vane groove extends across the entire vane face.

15. The spray nozzle of claim 14, wherein the female portion works operatively with an associated removal tool for the selective removal of the vane.

16. The spray nozzle of claim 15, wherein the at least one groove cuts across the threaded portion of the vane.

17. The spray nozzle of claim 16, wherein the at least one groove comprises at least three grooves, wherein the grooves intersect each other to form six triangular portions.

18. The spray nozzle of claim 17, wherein the six grooves on the threaded portion extend diagonally from the vane face to the second side at approximately a 45 degree angle.

19. The spray nozzle of claim 18, wherein the six grooves on the face form angles of approximately 60 degrees.

20. The spray nozzle of claim 19, wherein the six grooves extend to form notches on the second side of the vane, wherein the notches are at approximately 60 degree angles with respect to each other.

* * * * *